US005603624A

United States Patent [19]

Taguchi et al.

[11] Patent Number: 5,603,624

[45] Date of Patent: Feb. 18, 1997

[54] CONNECTOR WITH FITTING OPERATION LEVER

[75] Inventors: Naoto Taguchi; Hiroki Takahashi, both of Shizuoka, Japan

[73] Assignee: Yazki Corporation, Tokyo, Japan

[21] Appl. No.: 360,074

[22] Filed: Dec. 20, 1994

[30] Foreign Application Priority Data

Dec. 20, 1993 [JP] Japan ..... 5-319930

[51] Int. Cl.[6] ..... H01R 13/62

[52] U.S. Cl. ..... 439/157; 439/372

[58] Field of Search ..... 439/153–155, 439/157, 159, 372

[56] References Cited

U.S. PATENT DOCUMENTS

| | | | |
|---|---|---|---|
| 5,097,392 | 3/1992 | Tanaka et al. | 439/372 |
| 5,135,410 | 9/1992 | Kawase et al. | 439/157 |
| 5,174,785 | 12/1992 | Endo et al. | 439/489 |
| 5,230,635 | 7/1993 | Takenouchi et al. | 439/153 |
| 5,330,411 | 7/1994 | Fujitani et al. | 439/157 |
| 5,368,492 | 11/1994 | Hayashi | 439/157 |
| 5,382,176 | 1/1995 | Norden | 439/357 |

FOREIGN PATENT DOCUMENTS

| | | | |
|---|---|---|---|
| 487169 | 3/1992 | Japan | H01R 13/629 |
| 536775 | 5/1993 | Japan | H01R 13/629 |
| 536774 | 5/1993 | Japan | H01R 13/629 |
| 536773 | 5/1993 | Japan | H01R 13/629 |

*Primary Examiner*—David L. Pirlot
*Assistant Examiner*—Jill DeMello
*Attorney, Agent, or Firm*—Sughrue, Mion, Zinn, Macpeak & Seas

[57] ABSTRACT

The object of the invention is to allow a fitting operation lever to be set to an initial position with respect to a connector without particularly using a separate member such as a spring, the initial position being such a position as to allow driven pins of a mating connector to be received smoothly. The connector being made of a synthetic resin and having in a housing body thereof guide notches that receive the driven pins of the mating connector; and a fitting operation lever being made of the synthetic resin, the fitting operation lever having drive cam grooves corresponding to the driven pins and being pivotably disposed on the connector. An engagement portion disposed on the fitting operation lever is disposed so as to be releasable from an initial position setting lock portion disposed on the connector. Entrance portions of the drive cam grooves coincide with the guide notches at an initial position set condition in which the engagement portion is engaged with the initial position setting lock portion.

8 Claims, 10 Drawing Sheets

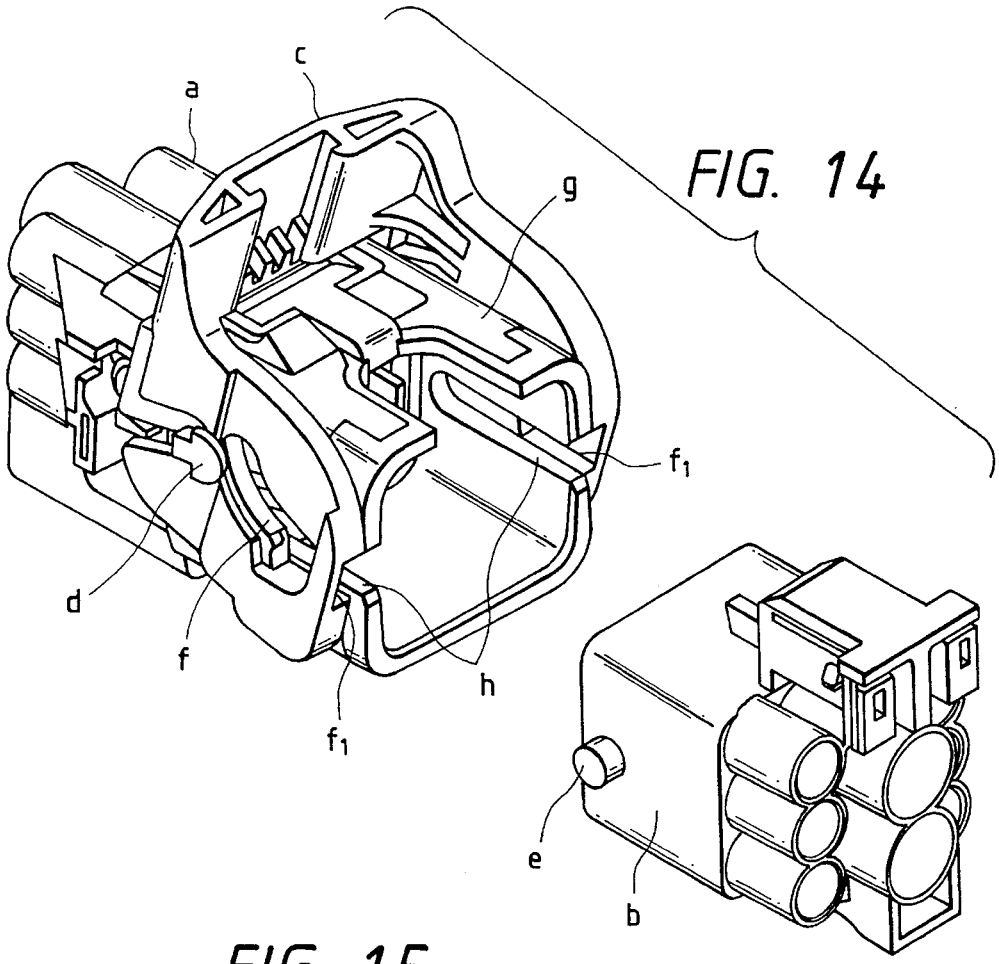
FIG. 14
FIG. 15
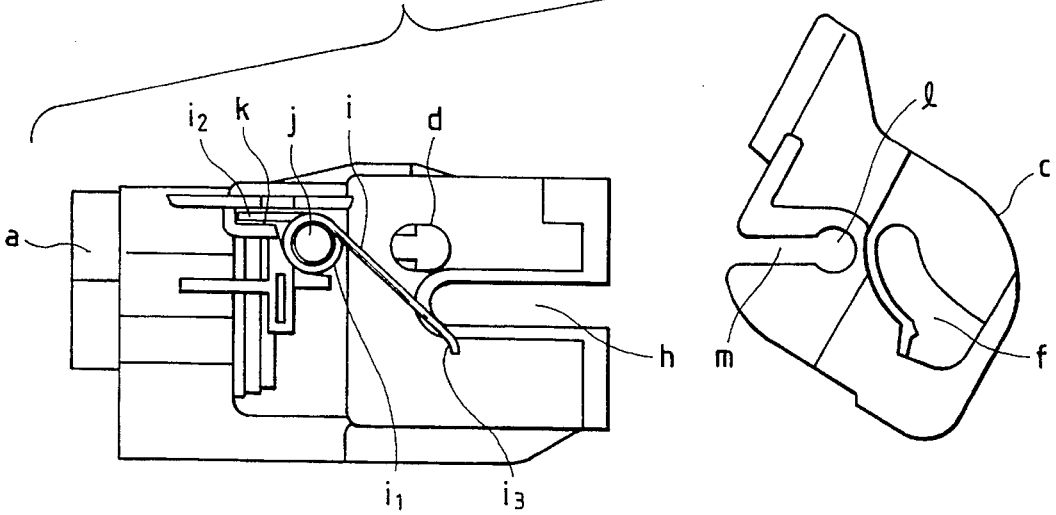

CONNECTOR WITH FITTING OPERATION LEVER

BACKGROUND OF THE INVENTION

1. Field of the Invention

The invention relates to a connector with a fitting operation lever used for connecting wire harnesses for automobiles or the like. More particularly, the invention is directed to a structure for setting the initial position of the fitting operation lever.

2. Related Art

In FIG. 14, reference character a denotes a female connector, and b, a male connector. A fitting operation lever c is pivotably arranged through pivots d on the female connector a. Drive cam grooves f corresponding to driven pins e of the male connector b are formed in the fitting operation lever c, and guide notches h for the driven pins e are formed in a housing body g of the female connector a.

At the initial stage of fitting the male connector b into the female connector a, the respective driven pins e must be engaged not only with the corresponding guide notches h but also with the corresponding drive cam grooves f. To implement this, initial position setting coil springs i are disposed on the fitting operation lever c so that entrances $f_1$ of the respective drive cam grooves f coincide with the corresponding guide notches h (see FIGS. 15, 16, 17).

Each initial position setting coil spring i is designed so that not only one end thereof $i_2$ is engaged with a retaining portion k while causing a coil portion $i_1$ to be engaged with a mounting shaft j, but also the other end $i_3$ thereof is engaged with the pivot d (FIG. 15), thus allowing the fitting operation lever c to be attached to the female connector a under this condition.

In the fitting operation lever are bearing holes l and guide notches m extending to the bearing holes l. The other end $i_3$ is abutted against a corresponding spring receiving portion n of the lever c when the bearing hole l is engaged with the pivot d through the guide notch m (FIG. 16). The other end $i_3$ moves away from the pivot d and gets engaged with the spring receiving portion n under the completely attached condition (FIG. 17).

In the aforementioned structure, spring members, each being an independent part, are necessary. The operation of attaching the spring members is time-consuming, laborious, and hence quite cumbersome and costly.

SUMMARY OF THE INVENTION

The invention has been made in consideration of the aforementioned circumstances and an object of the invention is, therefore, to allow the initial position of the fitting operation lever of the connector to be set without using such spring members.

To achieve the above object, the invention is applied to a connector with a fitting operation lever comprising: a connector being made of a synthetic resin and having in a housing thereof guide notches for receiving driven pins of a mating connector; and a fitting operation lever being made of a synthetic resin, having drive cam grooves corresponding to the driven pins, and being pivotably disposed on the connector. In such a connector with a fitting operation lever, an engagement portion disposed on the fitting operation lever is arranged so as to be releasable from an initial position setting lock portion disposed on the connector, and entrance portions of the drive cam grooves coincide with the guide notches in an initial position set condition in which the engagement portion is engaged with the initial position setting lock portion.

The invention is also applied to a connector with a fitting operation lever comprising: a connector being made of a synthetic resin and having in a housing thereof guide notches for receiving driven pins of a mating connector; and a fitting operation lever being made of a synthetic resin, being formed into a substantially C-shaped member with a pair of operation plate portions confronting an operation portion, having drive cam grooves corresponding to the driven pins on the operation plate portions, and being pivotably disposed on the connector by the operation plate portions. In such a connector with a fitting operation lever, positioning grooves having initial position setting lock portions and fitting locked condition checking tapered portions distant from the initial position setting lock portions are formed on outer surfaces of the connector, the outer surfaces confronting the operation plate portions; positioning engagement portions corresponding to the positioning grooves are disposed on the operation plate portions; so that when the positioning engagement portions are abutted against the initial position setting lock portions and the fitting locked condition checking tapered portions, the fitting operation lever expands to give the fitting operation lever resiliency; and fitting position engagement portions disposed on the fitting operation lever are engaged with fitted condition lock portion on the mating connector with the positioning engagement portions being abutted against the fitting locked condition checking tapered portions.

The operation plate portions are released from the initial position setting lock portion by the pair of connectors being fitted.

By applying an external force to the fitting operation lever in the initial position set condition, the fitting operation lever is released from the initial position set condition and pivots.

At the time the fitting operation lever is released from the initial position set condition, the fitting operation lever is given resiliency. If the fitted condition is not completely locked, the fitting operation lever pivots slightly reversely by the resiliency produced at the fitting operation lever.

BRIEF DESCRIPTION OF THE DRAWINGS

FIG. 14 is a perspective view of a conventional example;

FIG. 15 is a sectional view of a connector of FIG. 14 with a coil spring preset;

DESCRIPTION OF THE PREFERRED EMBODIMENTS

Figure 1:
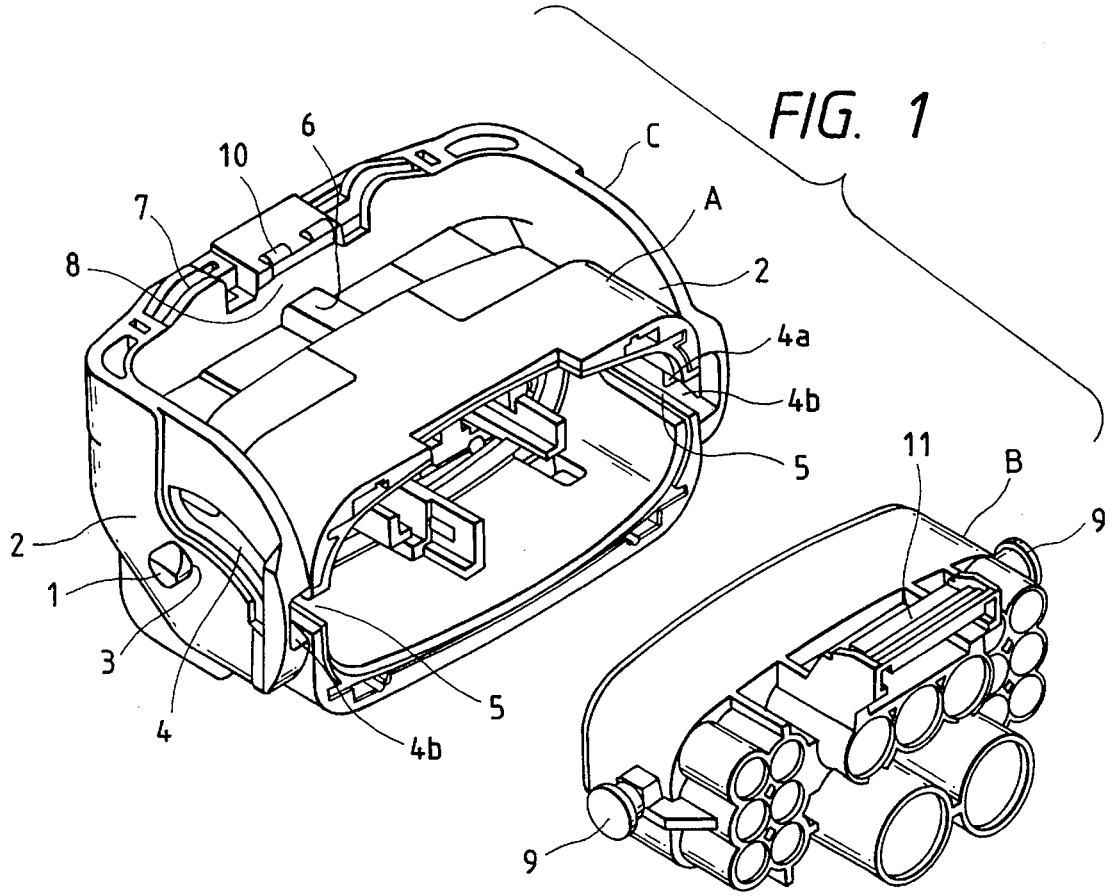
FIG. 1 is a perspective view of an embodiment of the invention with a pair of connectors separated from each other.
Figure 2:
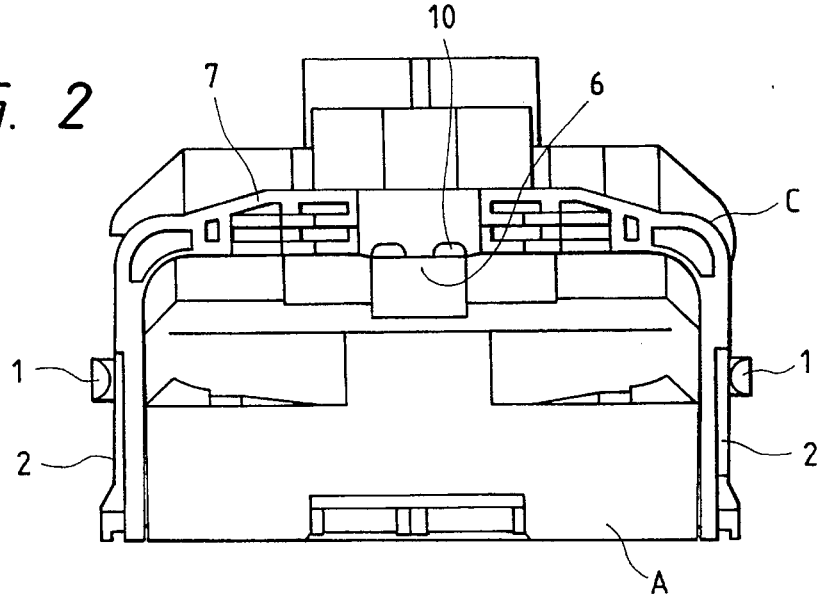
FIG. 2 is a plan view of the connector with a fitting operation lever of FIG. 1.

In FIG. 1, reference character A denotes a female connector and B, a male connector. Each connector is formed integrally using a synthetic resin material. Pivots 1 are formed on both sides of the female connector A so as to be projected therefrom, and a substantially C-shaped fitting operation lever C similarly integrally formed of a synthetic resin is disposed so as to be pivotable about the pivots 1.

Bearing holes 3 and eccentric drive cam grooves 4 are formed on each of a pair of operation plate portions 2 of the fitting operation lever C. Guide notches 5 corresponding to driven pins 9 on the male connector are formed on a housing body $A_1$ (not shown) of the female connector A so as to extend from the front end toward the rear. Tapered driven portions **4*b* are formed at the entrance portions of the respective drive cam grooves 4 through steps 4*a***.

Figure 7:
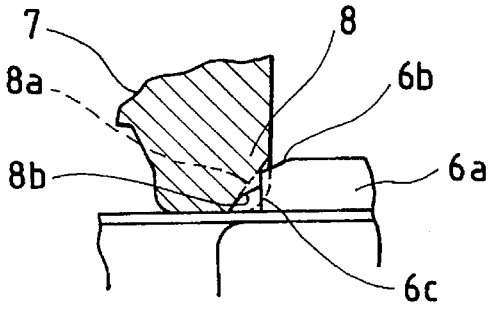
FIG. 7 is an enlarged view of a main portion of the pair of connectors of FIG. 1 as initially positioned.
Figure 8:
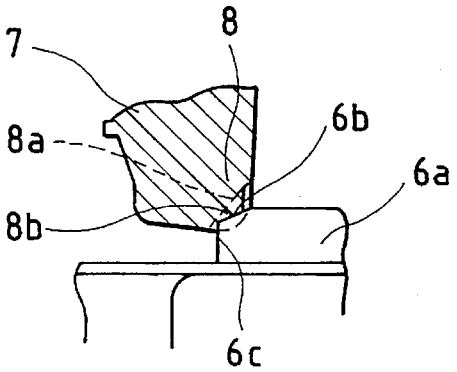
FIG. 8 is an enlarged view of a main portion of the pair of connectors of FIG. 1 as released from the initial position.

In the upper rear of the female connector A is an initial position setting lock portion 6 corresponding to the fitting operation lever C. An initial position setting engagement portion 8 corresponding to the initial position setting lock portion 6 is disposed on an operation portion 7 of the fitting operation lever C. As shown in FIGS. 7 and 8, the initial position setting lock portion 6 is formed by a bench portion **6*a* extending to a rear vertical surface 6*c* through a tapered engagement guide surface 6*b* at a rear corner thereof, whereas the initial position setting engagement portion 8 is formed by a small projected portion 8*b* formed on a tapered engagement guide surface 8*a* at a rear corner of the operation portion 7**.

Figure 3:
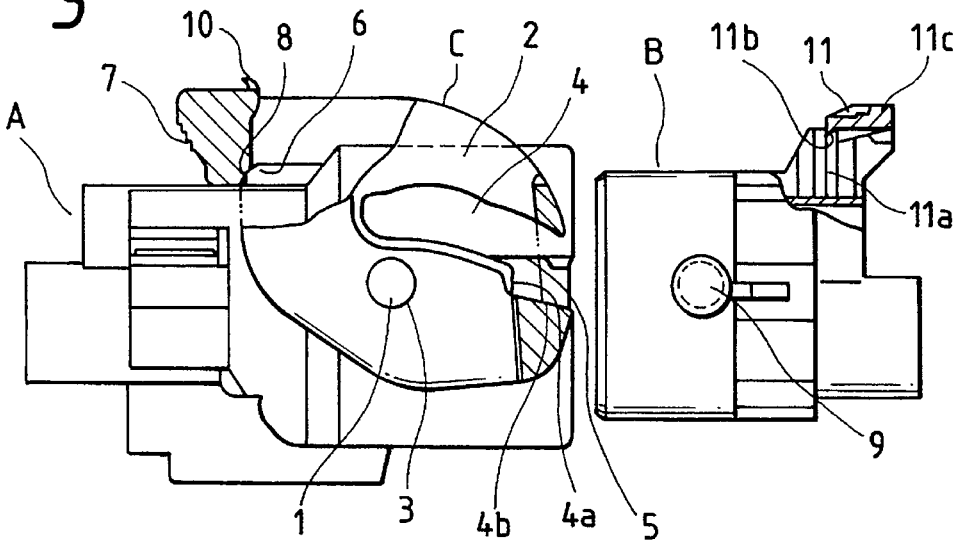
FIG. 3 is a partially cutaway sectional view of the pair of connectors of FIG. 1 before fitting.

In the aforementioned construction, the fitting operation lever C operates with respect to the female connector A in such a manner that the entrance portions of the driven cam grooves 4 are set to an initial position that coincides with the guide notches 5 upon engagement of the small projected portion **8*b* of the initial position setting engagement portion 8 with the vertical surface 6*c* of the initial position setting lock portion 6, so that the respective driven pins 9 of the male connector B are caused to confront the corresponding drive cam grooves 4 (FIGS. 3 and 7**).

Figure 4:
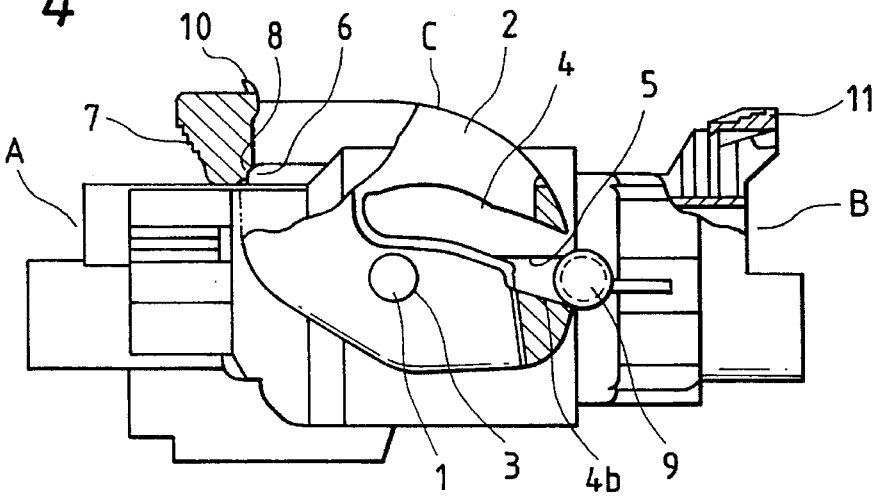
FIG. 4 is a partially cutaway sectional view of the pair of connectors of FIG. 1 at an initial stage of fitting.
Figure 5:
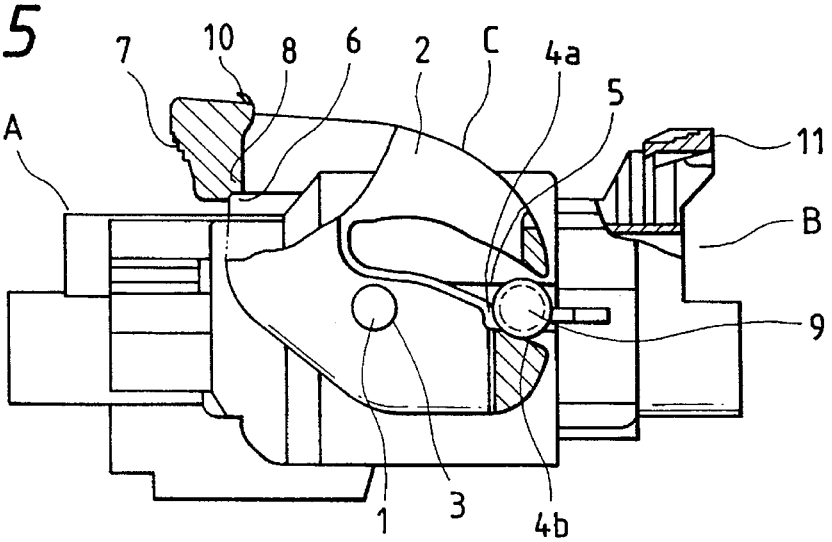
FIG. 5 is a partially cutaway sectional view of the pair of connectors of FIG. 1 at an intermediate stage of fitting.

When the fitting of the male connector B into the female connector A is started, the respective driven pins 9 enter into the corresponding guide notches 5 and the corresponding entrances of the drive cam grooves 4 (FIG. 4). As the fitting is further progressed, the driven pins 9 cause the fitting operation lever C to slightly pivot through the tapered driven portions **4*b*, thereby releasing the initial position locked condition of the fitting operation lever C (FIGS. 5 and 8**).

Figure 6:
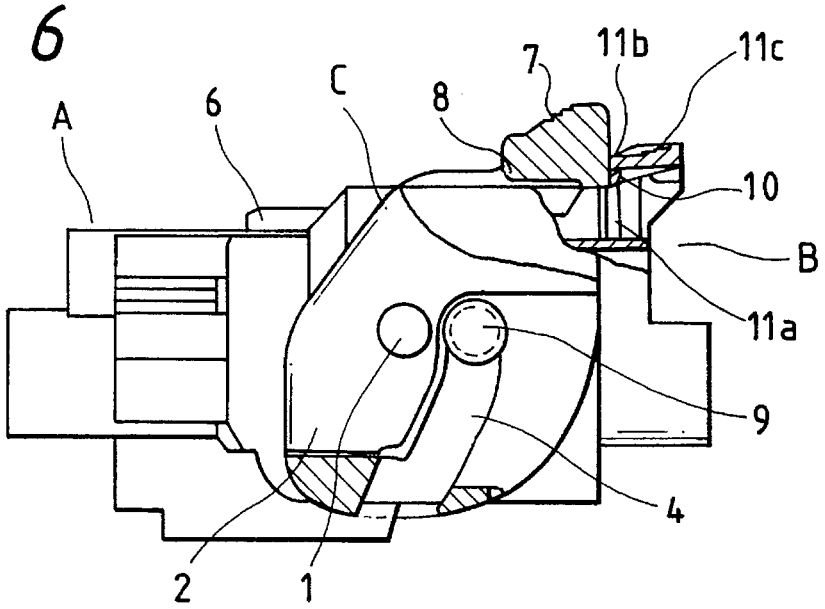
FIG. 6 is a partially cutaway sectional view of the pair of connectors of FIG. 1 as completely fitted.

When the fitting operation lever C is caused to pivot manually under this condition, the drive cam grooves 4 drive the fitting of the male connector B through the driven pins 9, and under the completely fitted condition, fitting position engagement portions 10 projected from the other side of the operation portion 7 lock the fitted condition while engaged with a fitted condition lock portion 11 disposed on top of the male connector B (FIG. 6).

The fitted condition lock portion 11 is formed by a retaining portion **11*b* formed on a flexible erected piece 11*a*. A lock release operation portion 11*c* is continuously formed on the flexible erected piece 11*a* (FIG. 6). By pressing the lock release operation portion 11*c*, the retaining portion 11*b* is moved toward the right as viewed in FIG. 6** to release the locking of the fitted condition.

Figure 9:
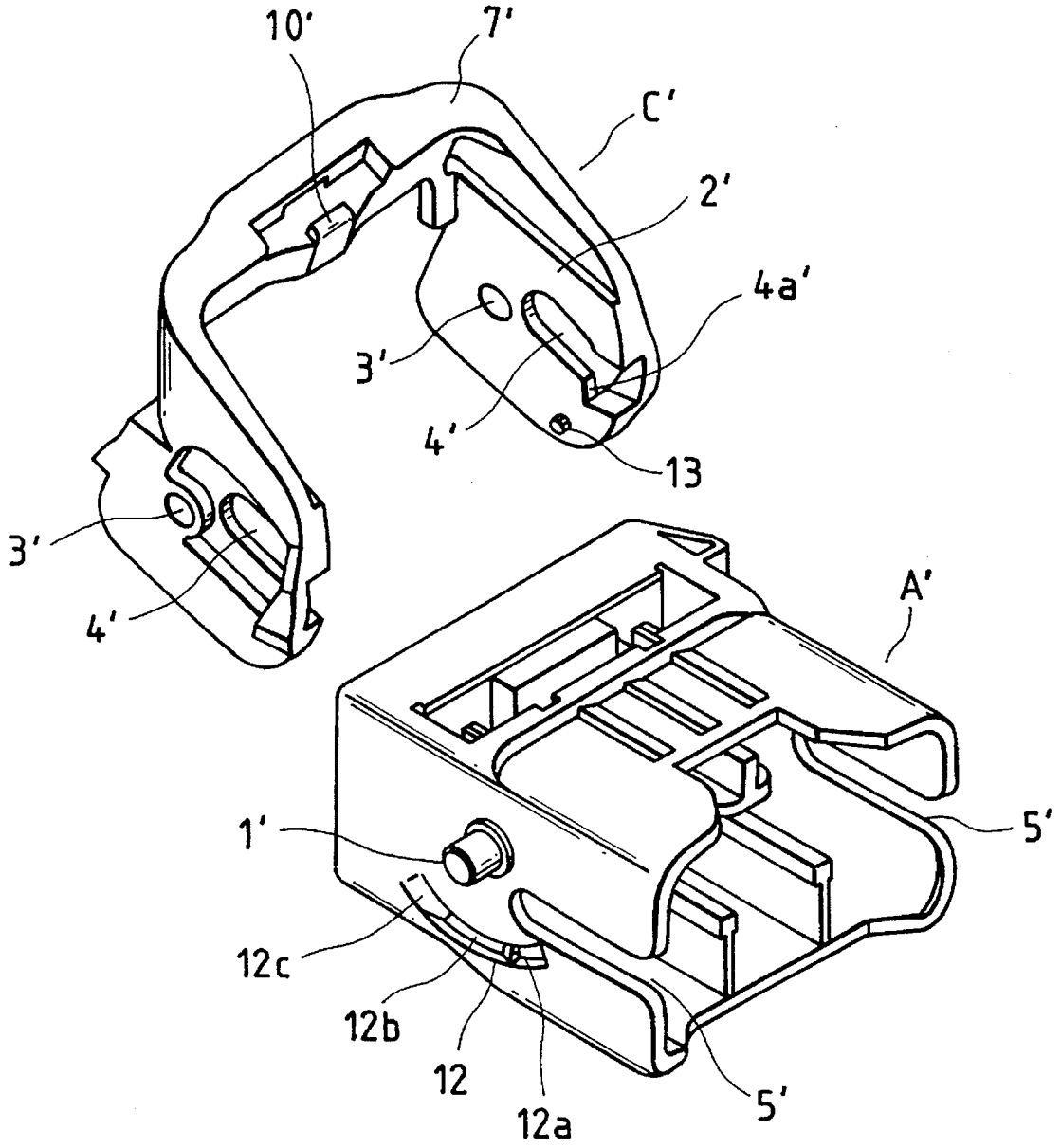
FIG. 9 is a perspective view showing another structure of the invention, in which the fitting operation lever is separated from the connector.

FIG. 9 shows in exploded form a female connector A' and a substantially C-shaped fitting operation lever C' according to another structure. Not only pivots 1' are projected from lateral walls of the female connector A', but also guide notches 5' and arcuate positioning grooves 12 are formed in such lateral walls. Each positioning groove 12 has an angularly projected initial position setting lock portion **12*a*, a flat portion 12*b*, and a fitting locked condition checking tapered portion 12*c*, which extend from the front to the rear (see FIG. 10**(B)).

In operation plate portions 2' of the fitting operation lever C' are not only bearing holes 3' but also drive cam grooves 4' having step portions **4*a'*, respectively. Positioning engagement portions 13 are also projected inwardly on the respective operation plate portions 2'**.

Figure 10A:
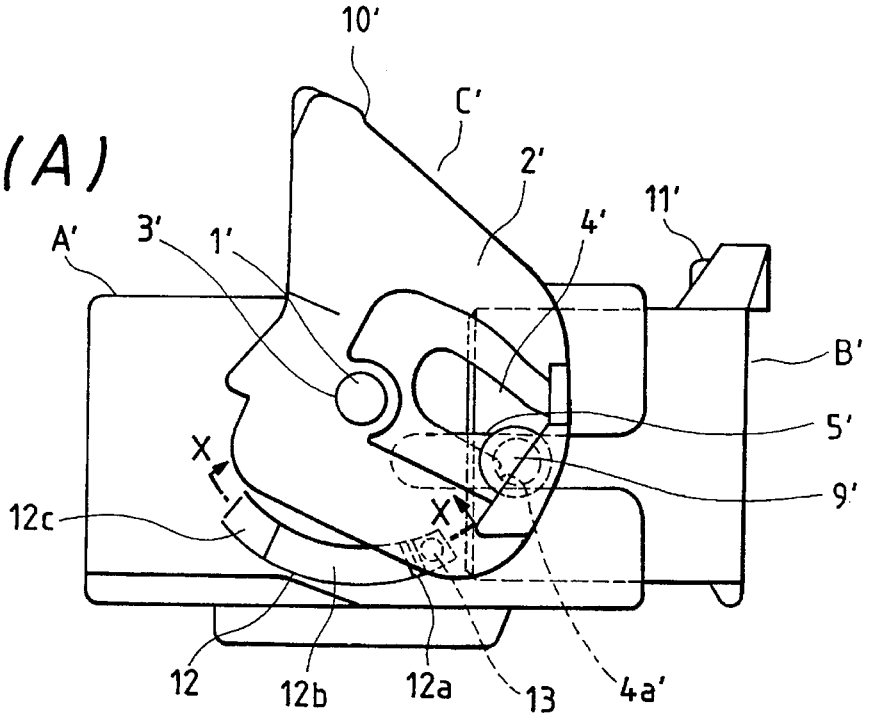
FIG. 10(A) is a side view of the pair of connectors as initially fitted.
Figure 10B:
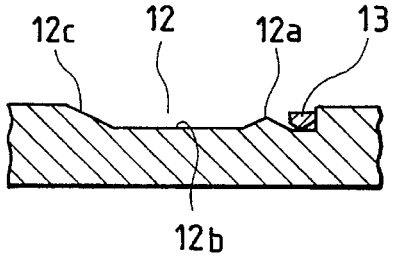
FIG. 10(B) is a sectional view taken along a line X—X of FIG. 10(A)
Figure 10C:
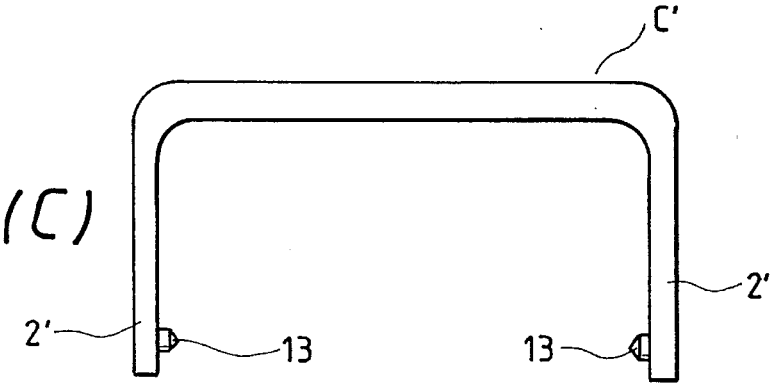
FIG. 10(C) is a front view of the fitting operation lever as initially fitted.

FIG. 10(A) shows the female and male connectors A', B' at the time fitting of these connectors is started. In the female connector A', the fitting operation lever C' is set to an initial position, and driven pins 9' of the male connector B' are positioned at the corresponding entrances of the drive cam grooves 4' that coincide with the guide notches 5', respectively. As shown in FIG. 10(B), a sectional view taken along a line X—X of FIG. 10(A), the respective positioning engagement portions 13 are engaged with the corresponding initial position setting lock portions **12*a*. Since the operation plate portions 2' of the fitting operation lever C' are not expanded, no resiliency is given to the operation plate portions 2' (FIG. 10** (C)).

Figure 11A:
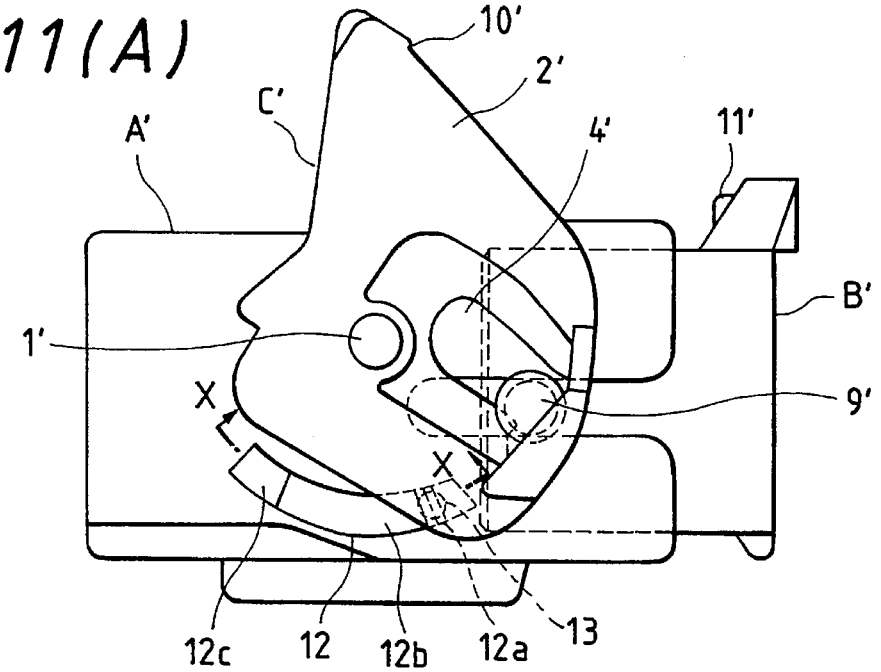
FIG. 11(A) is a side view of the pair of connectors in the course of being released from the initial position.
Figure 11B:
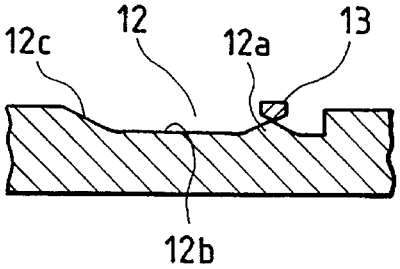
FIG. 11(B) is a sectional view taken along a line X—X of FIG. 11(A)
Figure 11C:
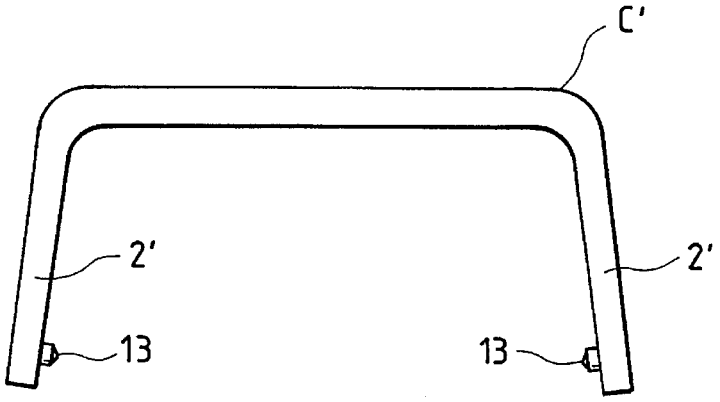
FIG. 11(C) is a front view of the fitting operation lever.

Then, when the fitting operation lever C' is caused to pivot manually, the respective positioning engagement portions 13 ride over the corresponding initial position setting lock portions **12*a* (FIGS. 11 (A), (B)), causing the operation plate portions 2' of the fitting operation lever C' to expand outwardly to give resiliency to the operation plate portions 2' (FIG. 11 (C)). Therefore, the fitting operation lever C' is not likely to pivot randomly from the initial position of FIG. 10**(A), but is fixed to the initial position.

Figure 12A:
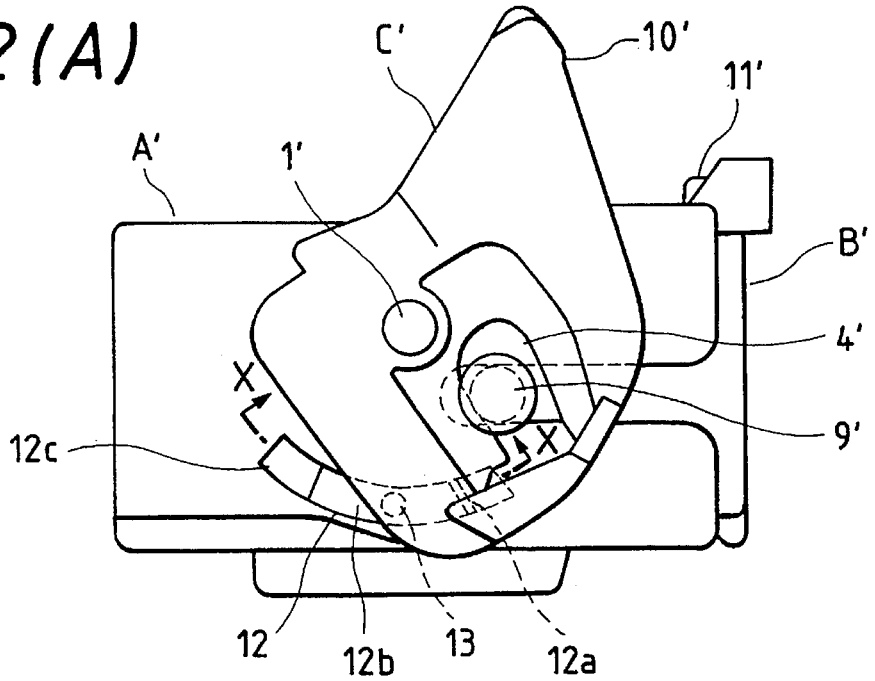
FIG. 12(A) is a side view of the pair of connectors in the course of being fitted.
Figure 12B:
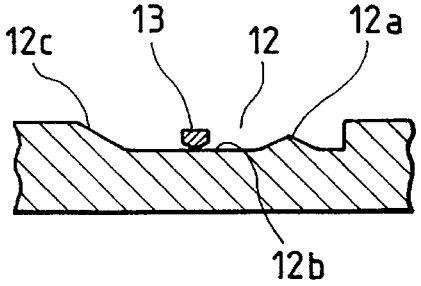
FIG. 12(B) is a sectional view taken along a line X—X of FIG. 12(A)
Figure 12C:
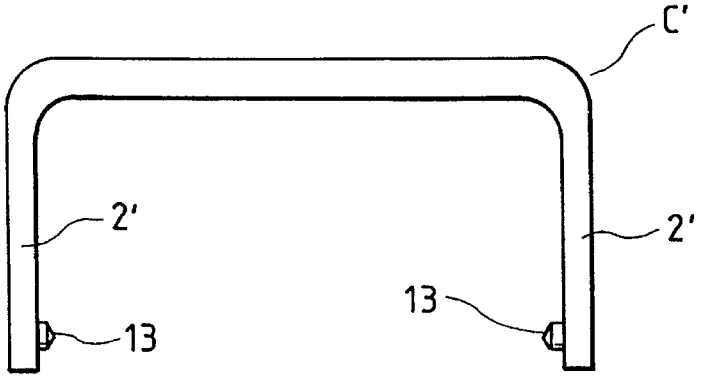
FIG. 12(C) is a front view of the fitting operation lever.

When the fitting operation lever C' is caused to pivot further, the respective positioning engagement portions 13 surpass the corresponding initial position setting lock portions 12*a* and enter into the flat portions 12*b* of the positioning grooves 12, so that the fitting of the male connector B' is driven (FIGS. 12 (A), (B)). Under this condition, the respective operation plate portions 2' return to the original position from the expanded condition and are, therefore, no longer given resiliency (FIG. 12 (C)).

Figure 13A:
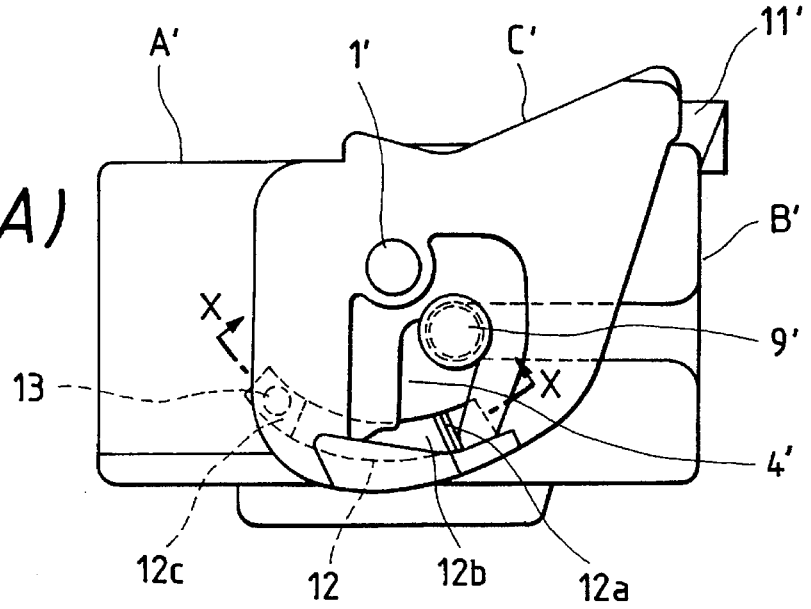
FIG. 13(A) is a side view of the pair of connectors as completely fitted.
Figure 13B:
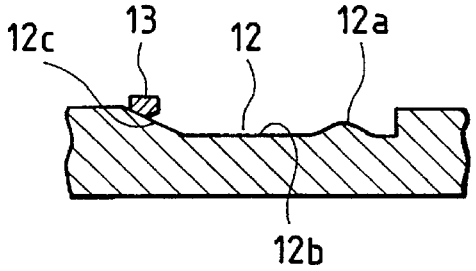
FIG. 13(B) is a sectional view taken along a line X—X of FIG. 13(A)
Figure 13C:
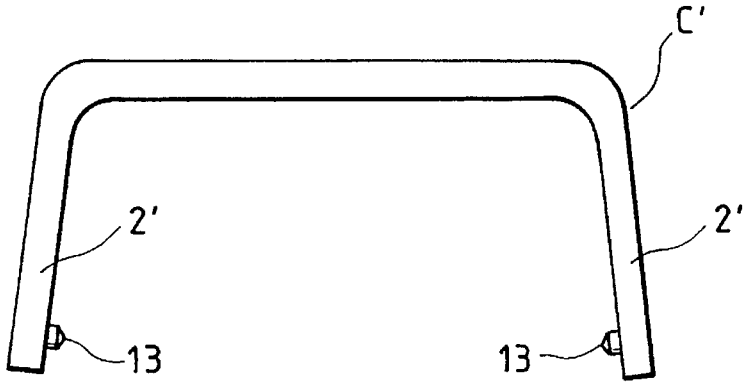
FIG. 13(C) is a front view of the fitting operation lever.
Figure 16:
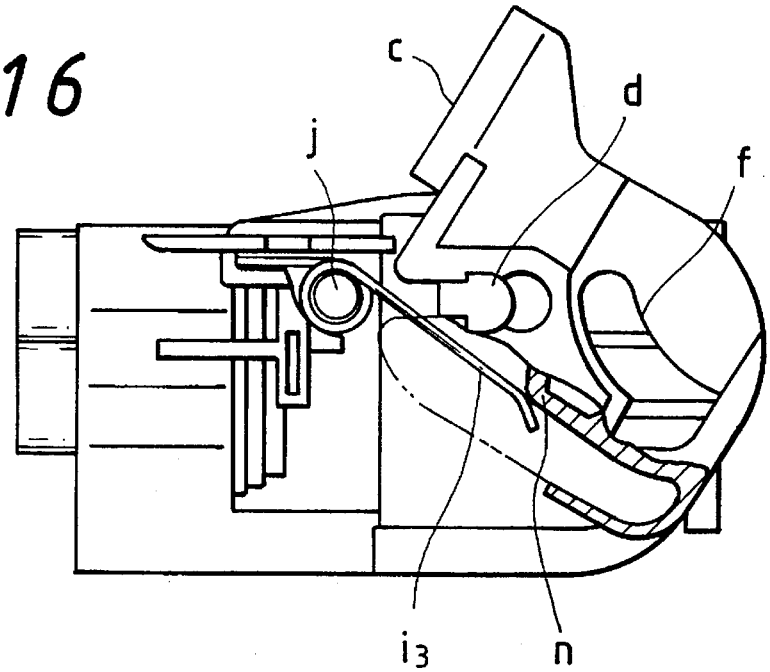
FIG. 16 is a partially cutaway side view of the connector of FIG. 14 in the course of attaching the fitting operation lever thereto.
Figure 17:
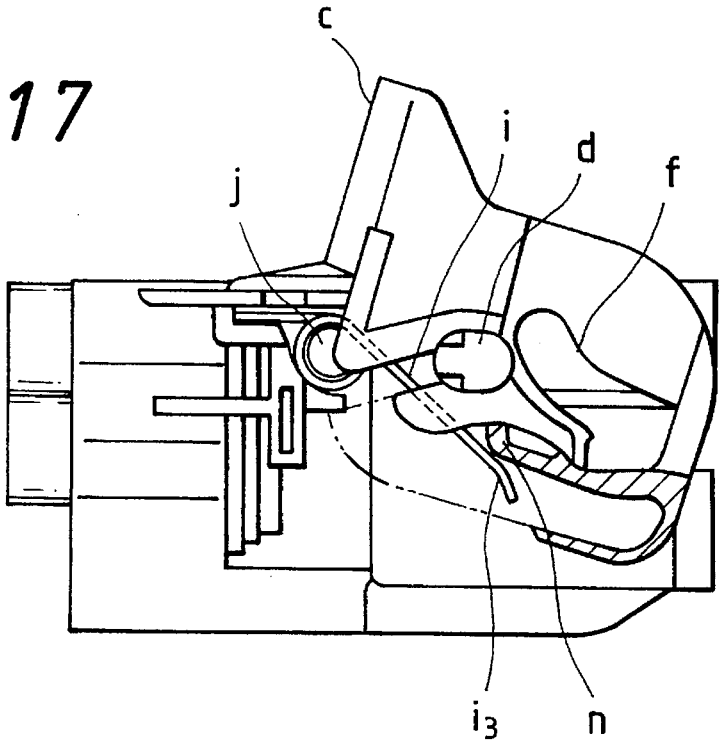
FIG. 17 is a partially cutaway side view of the connector of FIG. 14 with the fitting operation lever attached thereto.

It is at the pivot end position of the fitting operation lever C' that the fitting position engagement portions 10' formed on the operation portion 7' are engaged with the fitted condition lock portion 11' disposed on top of the male connector B'. At the pivot end position, the positioning engagement portions 13 are given resiliency by causing the respective operation plate portions 2' to expand outwardly while riding over the corresponding to fitting locked condition checking tapered portions 12*c* of the positioning grooves 12 (FIGS. 13 (A), (B), (C)). Therefore, unless the engagement portions 10' are locked into the lock portion 11' completely, the fitting operation lever C' returns to the original position, thereby easily checking the locked condition.

As was described above, in the present invention, the initial position for the fitting of a connector into a mating connector can be set by simply matching the structure of the connector with that of the fitting operation lever with using no particular independent members. Therefore, a simple design can be implemented with reduced cost.

In the present invention, resiliency is given to the fitting operation lever in the fitting completed condition when the fitting operation lever is released from the initial position. Therefore, the fitting operation lever is not likely to be out of the initial position irregularly. In addition, the fitting operation lever returns to the original position if the fitted condition is not locked. Therefore, whether the fitted condition is locked or not can be checked with ease.

What is claimed is:

1. A connector comprising:

a connector housing having guide notches formed on side surfaces of said connector housing for receiving driven pins of a mating connector;

a fitting operation lever pivotally disposed on the connector housing, and having drive cam grooves corresponding to the driven pins disposed on operation plate portions of the fitting operation lever;

an initial position setting lock portion disposed on an upper surface of the connector housing, said upper surface of said connector housing extending between said side surfaces;

an engagement portion arranged on an operation portion of the fitting operation lever for engaging with the initial position setting lock portion, wherein said operation portion extends between said operation plate portions when the fitting operation lever is in an initial position set condition, entrance portions of the drive cam grooves coincide with the guide notches and the engagement portion is engaged with the initial position setting lock portion.

2. A connector comprising:

a connector housing having guide notches on side surfaces thereof for receiving driven pins of a mating connector;

a fitting operation lever pivotally disposed on the connector housing, said fitting operation lever having a pair of operation plate portions extending from an operation portion and confronting the side surfaces, and having drive cam grooves corresponding to the driven pins on the operation plate portions;

positioning grooves having initial position setting lock portions and fitting locked condition checking tapered portions distant from the initial position setting lock portions, said positioning grooves being formed on the side surfaces of the connector housing;

positioning engagement portions corresponding to the positioning grooves disposed on the operation plate portions; and fitting position engagement portions disposed on the fitting operation lever for engaging with a fitting condition lock portion on the mating connector when the positioning engagement portions are abutted against the fitting locked condition checking tapered portions.

3. A connector as claimed in claim 2, wherein the fitting operation lever is expanded by abutting the positioning engagement portions against the initial position setting lock portions and the fitting locked condition checking tapered portions.

4. A connector as claimed in claim 2, wherein the operation plate portions are released from the initial position setting lock portions by fitting the mating connector to the connector housing.

5. A connector as claimed in claim 2, wherein the positioning engagement portions return from the fitting locked condition checking tapered portions to a flat portion when the fitting position engagement portions are incompletely locked into the fitted condition lock portion.

6. A connector comprising:

a connector housing having an initial position setting lock portion disposed in a positioning groove formed on a side surface of the connector housing; and a fitting operation lever pivotally disposed on the connector housing, said fitting operation lever having an engagement portion, wherein the connector housing and the fitting operation lever are set in an initial position set condition by engaging the engagement portion with the initial position setting lock portion.

7. A connector as claimed in claim 6, wherein the connector housing has guide notches for receiving driven pins of a mating connector.

8. A connector as claimed in claim 7, wherein the fitting operation lever has drive cam grooves for receiving the driven pins.

* * * * *